US005385074A

United States Patent [19]

Burch, Jr.

[11] Patent Number: 5,385,074

[45] Date of Patent: Jan. 31, 1995

[54] APPARATUS AND METHOD FOR CUTTING HELICALLY SHAPED POTATO PIECES

[75] Inventor: Russell E. Burch, Jr., Summerside, Canada

[73] Assignee: Cavendish Farms Limited, Prince Edward Island, Canada

[21] Appl. No.: 21,122

[22] Filed: Feb. 23, 1993

[51] Int. Cl.[6] ..... B26D 3/11

[52] U.S. Cl. ..... 83/865; 83/356.3; 83/437; 83/672; 83/932; 99/538; 198/625

[58] Field of Search ..... 99/538, 537; 83/865, 83/437, 356.3, 932, 591, 592, 596, 672; 198/625

[56] References Cited

U.S. PATENT DOCUMENTS

| | | | |
|---|---|---|---|
| 1,933,404 | 10/1933 | Allen et al. | 198/625 X |
| 1,991,304 | 2/1935 | Walter | 83/437 X |
| 3,483,686 | 12/1969 | Long et al. | 198/625 X |
| 3,507,382 | 4/1970 | Wells | 198/625 |
| 3,638,927 | 2/1972 | Wells | 198/625 X |
| 3,643,721 | 2/1972 | Haubner . | |
| 3,791,508 | 2/1974 | Osborne et al. | 198/625 |
| 3,874,259 | 4/1975 | Chambos et al. . | |
| 3,952,621 | 4/1976 | Chambos | 83/733 |
| 4,083,280 | 4/1978 | Commiant | 83/425.3 |
| 4,206,671 | 6/1980 | Hoehn | 83/408 |
| 4,237,782 | 12/1980 | Bichel | 99/625 |
| 4,367,667 | 1/1983 | Shibata | 83/356.3 |
| 4,387,111 | 6/1983 | Mullender | 426/615 |
| 4,512,228 | 4/1985 | Tarcisio | 83/355 |
| 4,526,128 | 7/1985 | Sorace et al. | 198/625 X |
| 4,619,192 | 10/1986 | Cycyk et al. | 99/538 |
| 4,625,606 | 12/1986 | Pinegar et al. | 83/403 |
| 4,628,808 | 12/1986 | Simon | 99/538 |
| 4,644,838 | 2/1987 | Samson et al. | 83/865 |
| 4,704,959 | 11/1987 | Scallen | 99/538 |
| 4,926,726 | 5/1990 | Julian | 83/165 |
| 4,979,418 | 12/1990 | Covert et al. | 83/865 |
| 5,010,796 | 4/1991 | Mendenhall | 83/865 |
| 5,035,915 | 7/1991 | Mendenhall | 426/637 |
| 5,089,286 | 2/1992 | Geissler et al. | 426/615 |
| 5,097,735 | 3/1992 | Mendenhall | 83/865 |
| 5,168,784 | 12/1992 | Foster et al. | 83/932 X |
| 5,211,098 | 5/1993 | Mendenhall | 83/865 |

FOREIGN PATENT DOCUMENTS

| | | | |
|---|---|---|---|
| 1225910 | 8/1987 | Canada . | |
| 2019595 | 2/1991 | Canada . | |
| 1308000 | 9/1992 | Canada . | |
| 136628 | 10/1985 | European Pat. Off. . | |
| 3143816 | 6/1991 | Japan | 198/625 |
| 9218296 | 10/1992 | WIPO | 83/672 |

OTHER PUBLICATIONS

Advertisement —GME, Inc. —"Your Customers will Jump for New GME Tater Shapes!".

*Primary Examiner*—Eugenia Jones
*Attorney, Agent, or Firm*—McFadden, Fincham

[57] ABSTRACT

An apparatus for cutting helically shaped pieces from potatoes has a top portion forming a drive section, a center portion forming a feed section and a lower portion forming a cutting section. The drive section comprises a plurality of rotatable shafts extending in a circle about a central axis. The feed section comprises a plurality of rotatable rods arranged in a circle about the central axis, each rod at its upper end connected to a lower end of a shaft. At least the lower part of each rod has a spiral outer surface. The cutter section includes a cutter of hollow conical form having a series of spiral channels on its interior surface, each spiral ending in an aperture, the apertures forming cutting edges. Potatoes are fed through the feed section, on rotation of the rods, by the spiral surfaces of the rods, and pushed into the cutter, which on rotation, cuts helical pieces from potatoes.

9 Claims, 7 Drawing Sheets

APPARATUS AND METHOD FOR CUTTING HELICALLY SHAPED POTATO PIECES

This invention relates to apparatus for the cutting of helically shaped potato strips and to method for such cutting.

Helical or spiral potato strips have been available for some time, providing an attractive form of strip. There are many forms of apparatus for cutting such strips. In many, a plurality of cutters arranged concentrically, cut a plurality of circles into a potato, and a further, transverse, cutter cuts across the circles to produce spirals. Other machines cut a single spiral, forming thin flat shapes.

Many of the forms of apparatus are quite complex and many of them feed the potatoes individually in a non-continuous manner.

The present invention provides a very simple and effective apparatus in which potatoes are feed continuously to a feed section which continuously pushes the potatoes into a cutting section in which spirals or helicals are cut from the potatoes. The potato is fed in one direction and is not rotated, being held by the feed mechanism. The cutting section includes a cutting member having a plurality of channel shaped cutters arranged concentrically about the rotational axis of the cutting member, spaced apart circumferentially, the cutters mounted on a concave conical surface.

Broadly, there is provided apparatus for cutting helically shaped potato pieces, comprising: a feed section and a cutting section in series and in alignment on a longitudinal axis, the feed section including means for feeding potatoes in sequence to the cutting section; the cutting section including a hollow conical cutting member having a series of spiral channels on its inner surface, and means for rotating the cutting member about its axis, each channel ending in an aperture extending through the wall of the cutting member and forming cutting edges, the spiral channels immediately adjacent each other, and the apertures spaced apart around the inner surface and facing in the direction of rotation of the cutting member.

In a particular arrangement, apparatus for cutting helically potato pieces comprises a top portion forming a drive section, a center portion forming a feed section and a lower portion forming a cutting section. The drive section has a plurality of shafts rotatably mounted, these shafts extending in a circle about a central axis, means being provided for rotating the shafts. The feed section comprises a plurality of rods rotatably mounted and extending in a circle about the central axis. Each rod is connected at an upper end in a flexible manner to a lower end of one of the shafts and at least a lower portion of each rod has a spiral screw-like outer surface. A guide member at an intermediate position along the rods has a plurality of elongate radially extending slots, a rod positioned in each slot. The cutting section comprises a driving member mounted for rotation about the central axis and including a cutting member attached to the lower end of the driving member, the cutting member in the form of hollow conical member having a series of spiral channels on the inner surface, each channel ending in an aperture extending through the wall of the cutter member and forming cutting edges. These spiral channels are immediately adjacent each other and the apertures are positioned in a spiral around the cutter member.

The invention also includes a method of cutting helically shaped potato pieces in which the potatoes are fed successively along a central axis by plurality of rotating rods positioned around the central axis, each of the rods having a spiral circumference, pushing the potatoes into a cutting member of hollow, conical form with a plurality of spiral channels on the inner surface, each channel ending in an aperture forming cutting edges, and rotating the cutting member about the central axis to cut helically shaped pieces from the potatoes.

The invention will be readily understood by the following description, in conjunction with accompanying drawings, in which.

Figure 1:
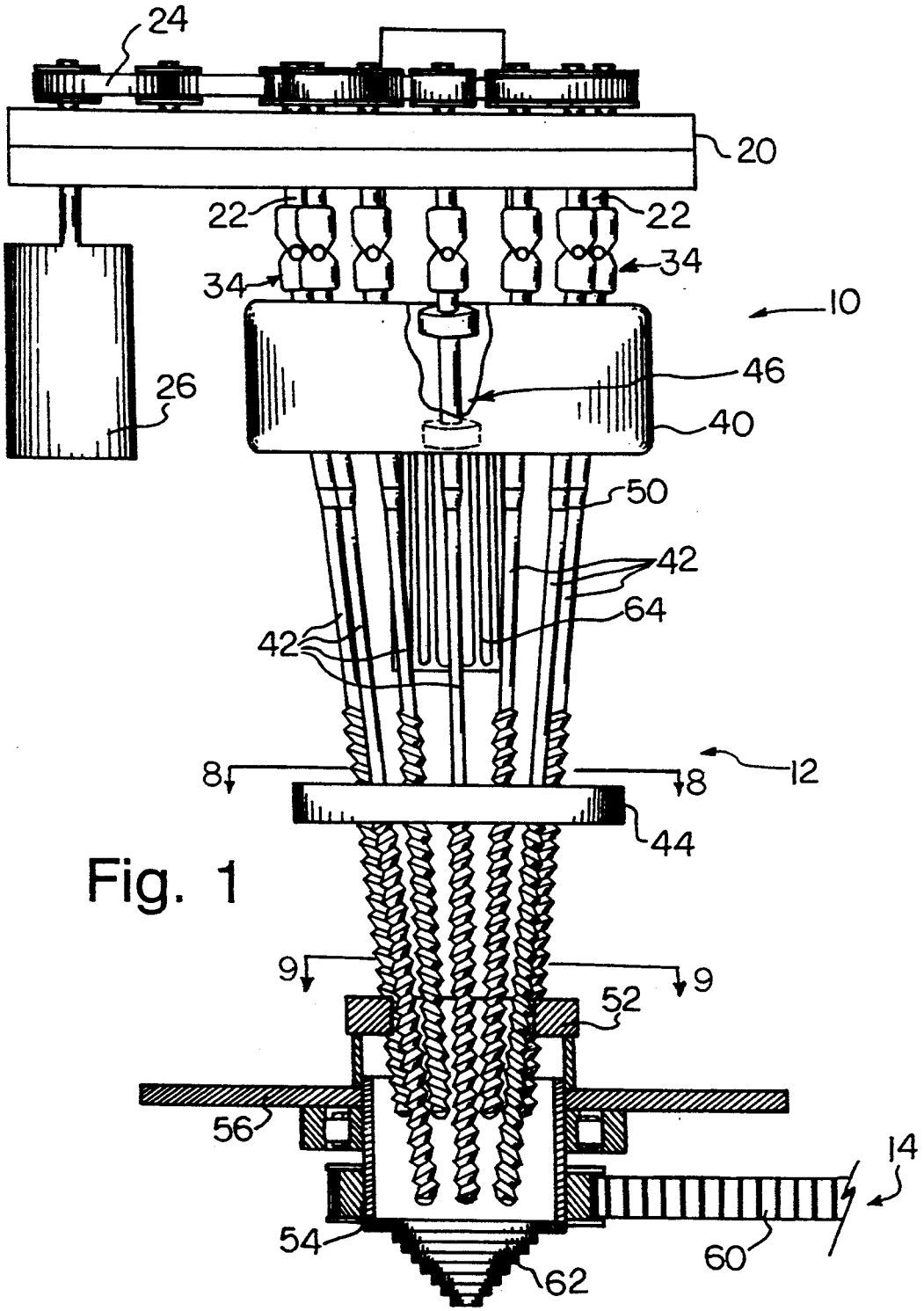
FIG. 1 is a front view of one form of the apparatus in accordance with the present invention, with the lower part in cross-section.

As illustrated in FIG. 1, the apparatus has a top section 10 comprising a drive section, a center section 12 comprising a feed section, and a lower section 14 comprising a cutting section.

Figure 2:
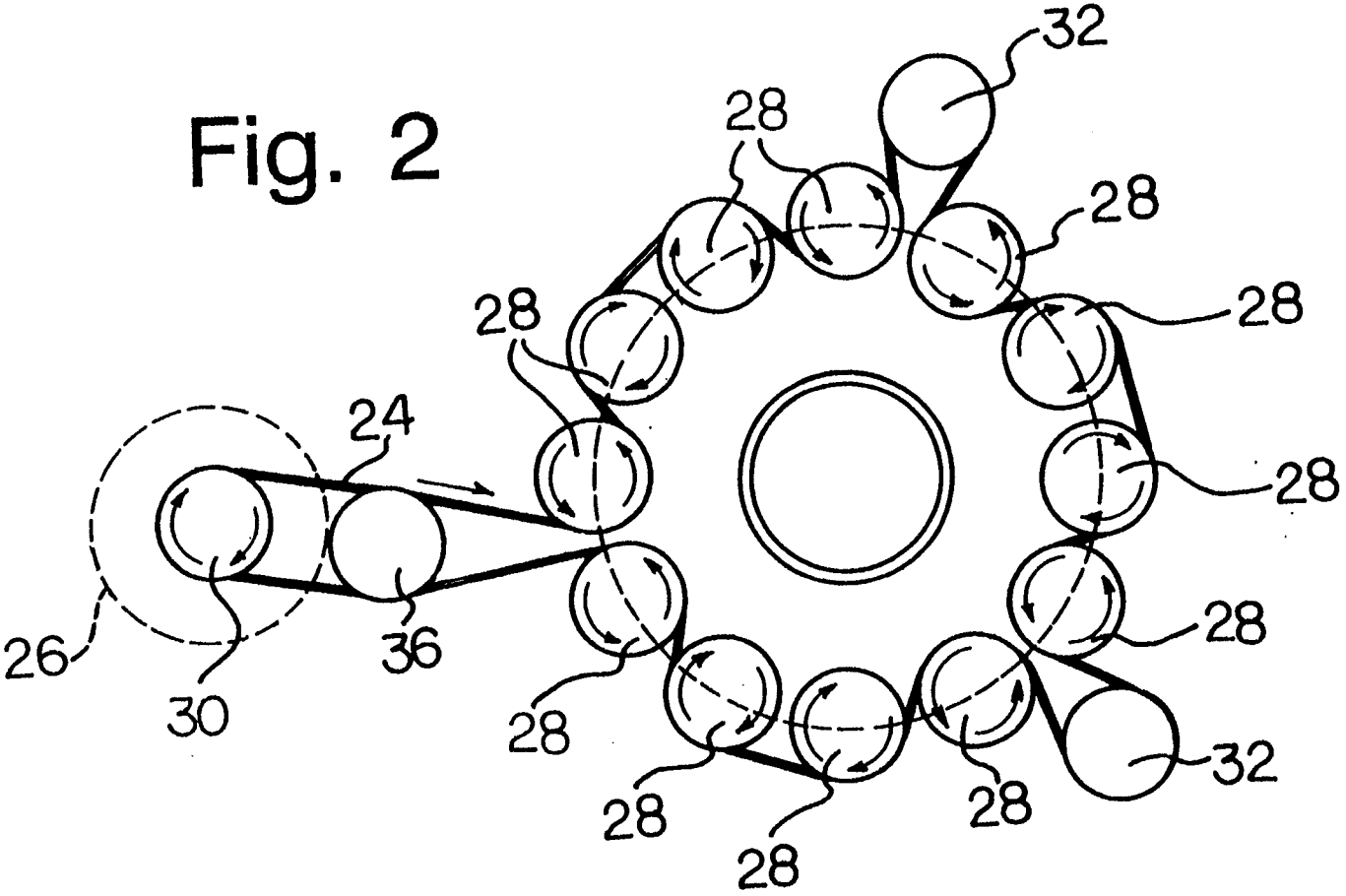
FIG. 2 is a top plan view illustrating the drive system for the shafts.

The top section 10 has an upper frame member 20 in which are rotatably supported a series of shafts 22 arranged in a circle, driven at their top ends, for example by a toothed belt 24 which passes around the outside of the circle, engaging with each shaft, and driven by a motor 26. The driving arrangement is illustrated in FIG. 2. A drive pulley 28 is attached to the upper end of each shaft 22. In the example, the belt 24 passes around the drive pulleys 28 from drive pulley 30 on the motor 26. Idler pulleys 32 provide for tensioning of the belts 24. The belt 24 alternates around the drive pulleys 28, in pairs, to rotate the drive pulleys, and thus the associated shafts, which are driven in what can be considered to be as pairs. For example, in FIG. 2, starting after the motor pulley 30 and an idler 36, and proceeding clockwise, the first pulley 28 and associated shaft 22, rotates anticlockwise, the next two pulleys 28 and their shafts 22 rotate clockwise, the next two pulleys and their shafts 22 rotate anticlockwise and so on until the last pulley 28 and its shaft 22 rotates anticlockwise in conformity with the first pulley. The lower ends of the shaft 22 are connected to the upper ends of the rods by U joints 34.

The center section 12 comprises a top support member 40 and a series of rods 42, and a mid-guide member 44. At their top ends the rods 42 are supported in the top support member 40, one such support being illustrated at 46 in cross-section. At their upper portions rods in the example are smooth and at their lower portions the rods have a spiral or threaded outer surface. In the example, the spiral or threaded outer surfaces are of opposite hand for adjacent rods of a pair. That is for example one rod of a pair has a right-hand thread and the other has a left-hand thread, to conform with the rotation applied via shafts 22 and pulleys 28. The mid-guide member 44 has a series of radial slots 48, and the rods 42 can move radially only while rotating about their own axes. The rods are machined towards their upper ends, for example at 50, to provide a flexing position, for example of reduced cross-section. The rods flex at this position as potatoes are fed through the apparatus.

The lower section 14 comprises a bottom guide member 52 and a driving member 54 rotatably supported in support member 56 The driving member 54 is hollow, and at its lower end is driven or rotated, by a toothed belt 60. Attached to the lower end is a cutting member 62. A guide tube 64 extends down into the center of the feed section to guide potatoes into the feed section. The guide member 52 has radial slots 58 for the rods 42.

The guide member 44 and the top support member 40 are rigidly supported from the top frame member 20 via rod not shown. The lower support member 56 and the upper frame member are connected by rods (not shown).

Figure 3:
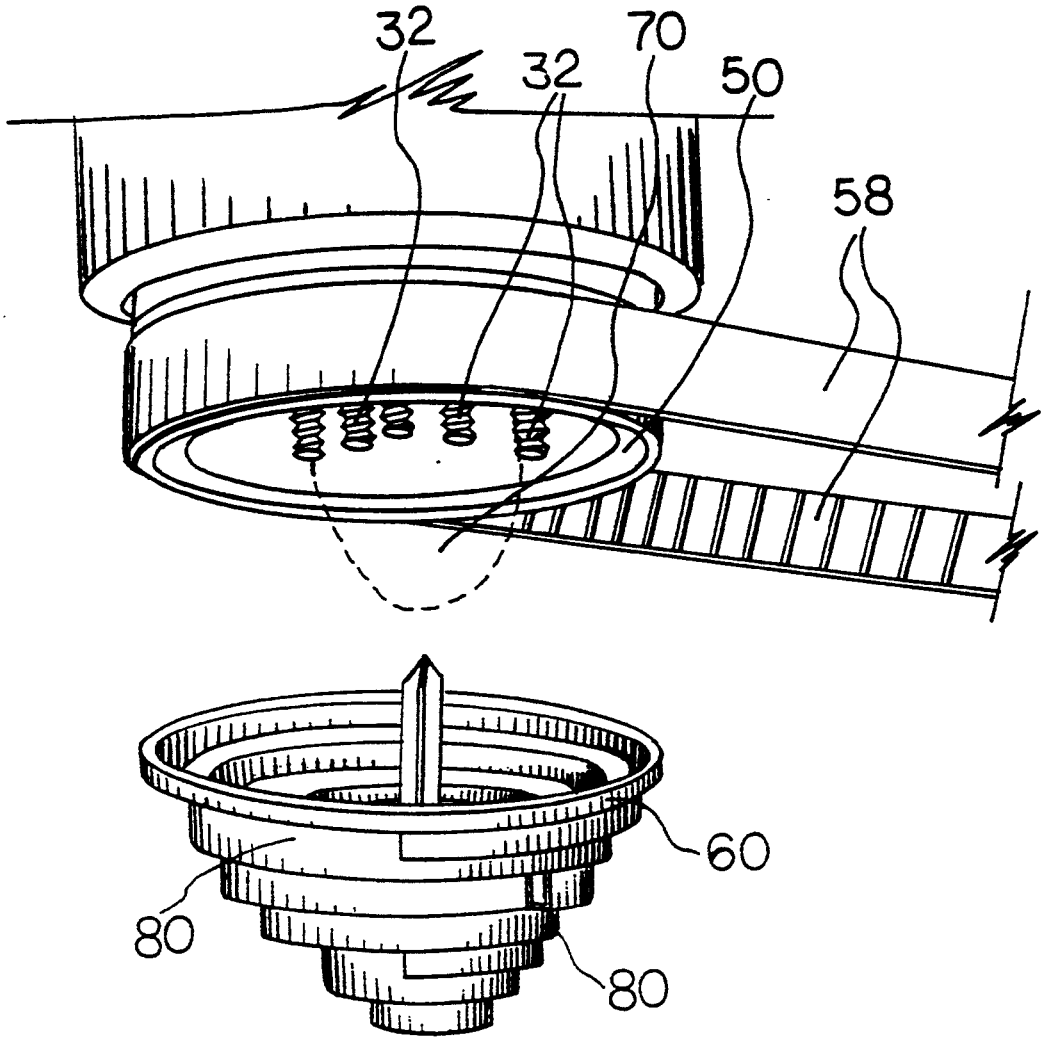
FIG. 3 is a view on the lower end of the feeding section, with the cutter shown removed.

FIG. 3 is a view looking up at the lower end of the drive member 54. In this view the lower ends of the rods 42 are seen. Also, a potato 70 is shown being fed down by the spiral surfaces of the rods 42. The cutter 62 is shown removed and spaced from the bottom of the drive member, to which it is removably attached. The cutter comprises a hollow conical member having a series of spiral channels on its inner surface, the channels ending at rectangular apertures extending through the wall of the cutter and forming cutting edges which cut rectangular section lengths from the periphery of the potatoes. The formation of the spiral channels is seen partly in FIGS. 3 and 4 in which the external surfaces of channels 80 are shown and the apertures 82, with cutting edges 84. The channels are side-by-side, the apertures staggered around the cutter periphery in a spiral arrangement. As the potato is pushed into the cutter, it is engaged by the cutting edges 84. The entire periphery of the potato is engaged, with a series of continuous spirals being cut from the potato. The whole potato is cut into spirals.

Figure 4:
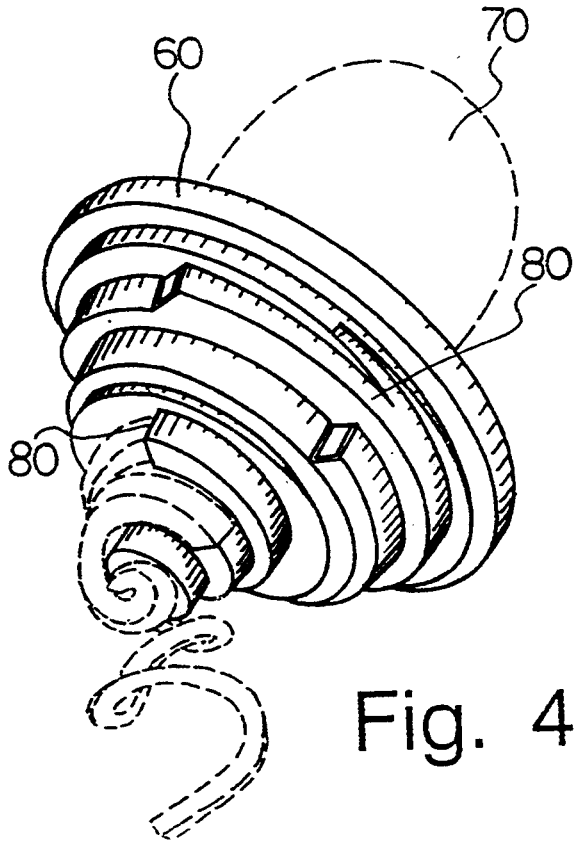
FIG. 4 is an external perspective view of the cutter.

FIG. 4 shows the cutter with a potato 70 which has been fed into the cutter and spiral lengths of cut potato exiting through the apertures 82.

Figure 7:
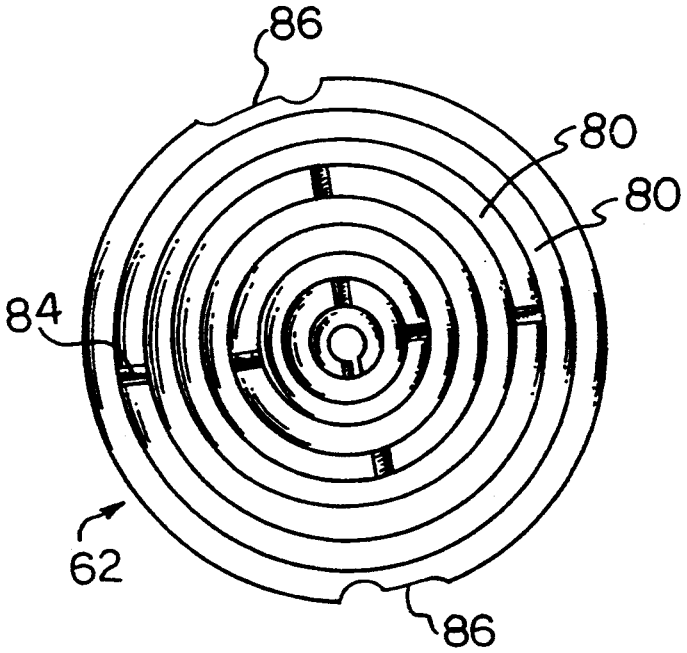
FIG. 7 is a plan view of the cutter showing the inside.
Figure 5:
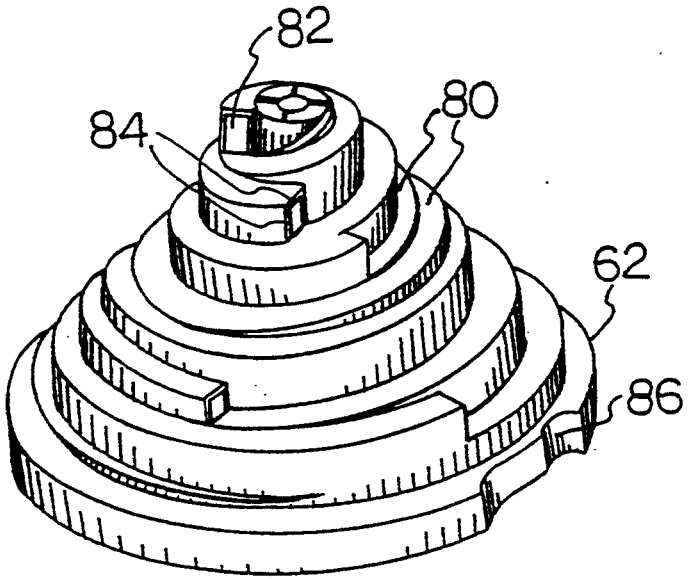
FIG. 5 is an outside perspective view of the cutter.
Figure 6:
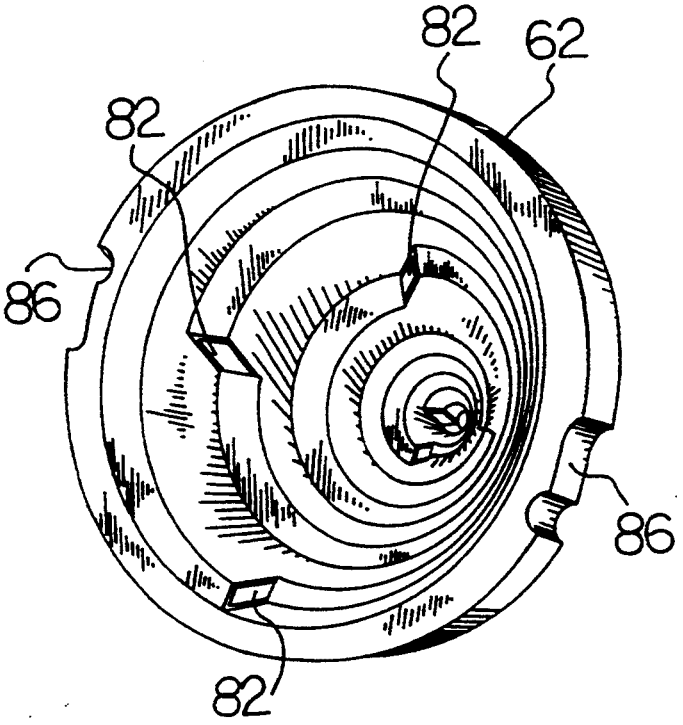
FIG. 6 is an inside perspective view of the cutter.
Figure 8:
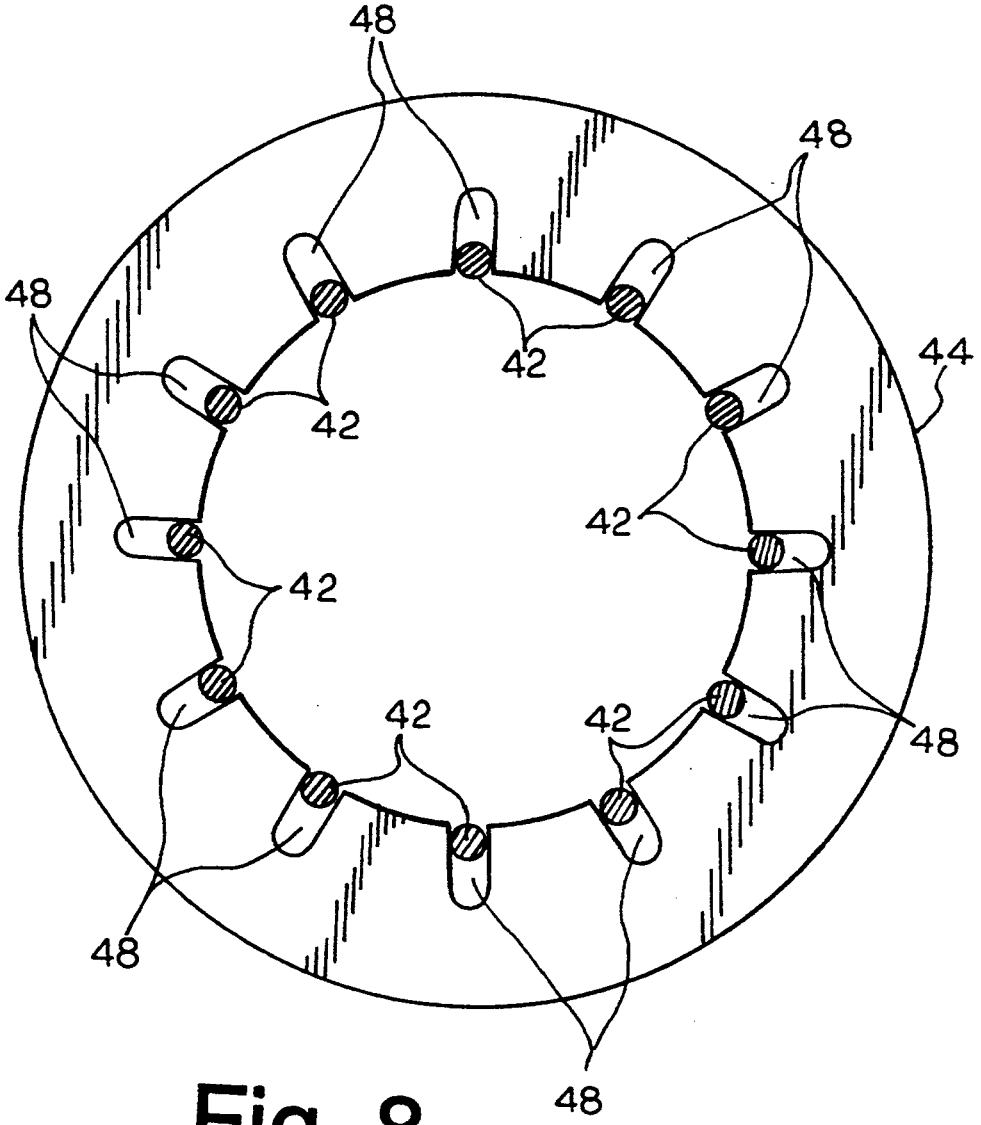
FIG. 8 is a cross-section on the line 8—8 of FIG. 1.
Figure 9:
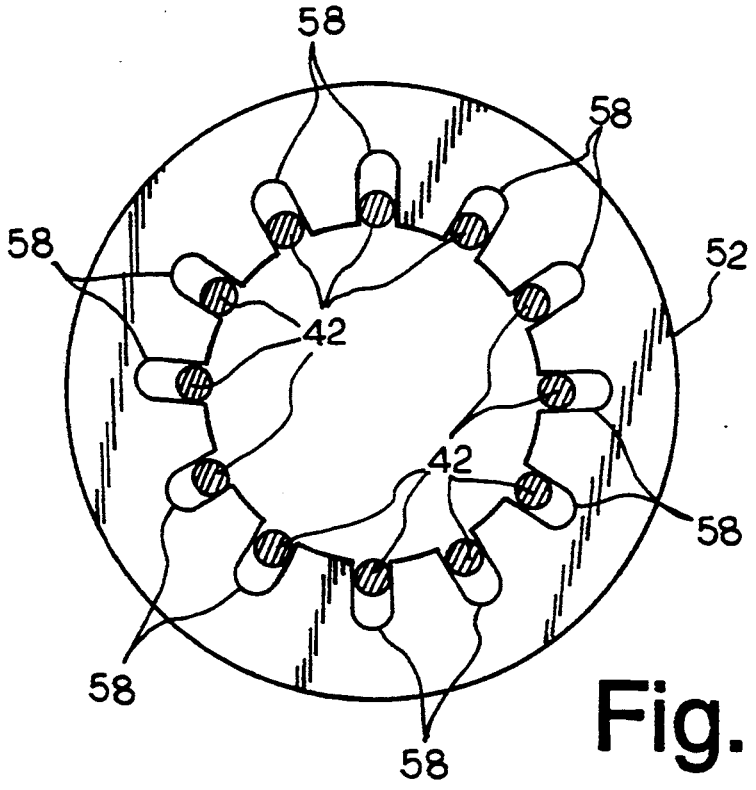
FIG. 9 is a cross-section on the line 9—9 of FIG. 1.

FIGS. 5, 6 and 7 illustrate the cutter 62 in different views. The channels are in the form of parallel spirals, i.e. each channel is a complete circle with the degree of spiral being the dimension of the aperture in a direction normal to the surface of the channel. The width of each aperture is the width of the spiral, the apertures being defined at their sides by the channel walls. In the example, the apertures are staggered around the cutters to form four radial rows.

Also seen in FIGS. 5, 6 and 7, are key slots or grooves 86 which engage with cooperative key members in a drive collar at the lower end of the drive member 54.

I claim:

1. A method for cutting helically shaped potato pieces comprising:

feeding potatoes successively along a central axis by rotating a plurality of rods positioned around said central axis, each of said rods having a spiral screw-like outer surface and being resiliently biased inwardly towards said central axis to grip said potatoes, pushing said potatoes into a cutting member of hollow conical form with a plurality of spaced channels on an inner surface each ending in an aperture forming cutting edges by further rotating said rods, and rotating said cutting member about said central axis to cut helically shaped pieces from said potatoes.

2. Apparatus for cutting helically shaped potato pieces, comprising:

a top portion comprising a drive section, a center portion comprising a feed section and a lower portion comprising a cutting section, said portions in series;

said drive section comprising a plurality of shafts rotatably mounted in an upper frame member, said shafts extending in a circle about a central axis, and means for rotating said shafts at upper ends thereof;

said feed section comprising a plurality of rods rotatably mounted in a top support member at an upper part of each rod, said rods extending in a circle about said central axis, each rod at an upper end flexibly connected to a lower end of one of said shafts and including for at least a lower portion of each rod a spiral, screw-like, outer surface, and a mid-guide member spaced down from said top support member having a plurality of elongate radially extending slots, one of said rods positioned in each of said slots;

said cutting section comprising a driving member mounted for rotation about said central axis, means for rotating said driving member, and a cutting member attached to a lower end of said driving member for rotation therewith, said cutting member comprising a hollow conical member having a large diameter open inlet end and a lower apex end, said large diameter inlet end facing towards said feed section, said hollow conical member having a series of spiral channels on an inner surface, each channel ending in an aperture extending through a wall of the cutting member and forming cutting edges, said spiral channels being immediately adjacent each other and the apertures being positioned in a spiral around the cutting member.

3. Apparatus as claimed in claim 2, said driving member including a bottom guide member having a plurality of radially extending slots, a lower end of each of said rods being positioned in a respective one of said slots in said bottom guide member.

4. Apparatus as claimed in claim 2, said rods inclined inwardly towards said central axis, and including means resiliently biasing said rods against radially outward deflection.

5. Apparatus as claimed in claim 2, said means for rotating said shafts including a motor, a pulley on said motor, a pulley on the upper end of each shaft and an endless belt extending around said pulley on said motor and said pulleys on said shafts, adjacent shafts rotating in opposite directions.

6. Apparatus as claimed in claim 2, including means resiliently biasing said rods against outward deflection, comprising a resiliently flexible section at the upper part of each rod.

7. Apparatus for cutting helically shaped potato pieces, comprising:

a top portion comprising a drive section, a center portion comprising a feed section and a lower portion comprising a cutting section, said portions in series;

said drive section comprising a plurality of shafts rotatably mounted in an upper frame member, said shafts extending in a circle about a central axis, and means for rotating said shafts at upper ends thereof;

said feed section comprising a plurality of rods rotatably mounted in a top support member at an upper part of each rod, said rods extending in a circle about said central axis, each rod at an upper end flexibly connected to a lower end of one of said shafts, means for mounting said rods, each rod including in a lower portion thereof, a spiral, screw-like outer surface, and a mid-guide member spaced down from said top support member having a plurality of elongate radially extending slots, one of said rods positioned in each of said slots.

8. Apparatus as claimed in claim 7, said rods inclined inwardly towards said central axis, and including means resiliently biasing said rods against radially outward deflection.

9. Apparatus as claimed in claim 8, said means resiliently biasing said rods against outward deflection comprising a resiliently flexible section at the upper part of each rod.

* * * * *